US005299970A

United States Patent [19]

Fontaine

[11] Patent Number: 5,299,970

[45] Date of Patent: Apr. 5, 1994

[54] GUIDED ROLLING CIRCLE GAME

[76] Inventor: Serge Fontaine, P.O. Box 476646, Chicago, Ill. 60647

[21] Appl. No.: 969

[22] Filed: Jan. 6, 1993

[51] Int. Cl.[5] ..... A63H 33/02

[52] U.S. Cl. ..... 446/453

[58] Field of Search ..... 273/126 R, 425; 446/450, 451, 452, 453, 431

[56] References Cited

U.S. PATENT DOCUMENTS

| | | | |
|---|---|---|---|
| 1,324,841 | 12/1919 | Merwin | 446/452 |
| 2,984,937 | 5/1961 | Rendon | 446/450 |
| 3,001,324 | 9/1961 | Walker | 446/450 |
| 3,123,937 | 3/1964 | Pace | 446/450 |
| 3,956,851 | 5/1976 | Tapinekis | 446/450 |
| 4,917,650 | 4/1990 | Paultre | 446/453 |

FOREIGN PATENT DOCUMENTS

| | | | |
|---|---|---|---|
| 11809 | of 1890 | United Kingdom | 446/450 |

*Primary Examiner*—William H. Grieb
*Attorney, Agent, or Firm*—Wood, Phillips, VanSanten, Hoffman & Ertel

[57] ABSTRACT

A game having a ring with a peripheral outer surface to be engaged with and rolled over a subjacent surface supporting the ring and a pusher for propelling the ring by rolling thereof. The pusher is a rod having a proximal and a distal end with the proximal end being configured to be gripped by a user. The distal end of the rod cooperates with the ring in such a manner that the user can selectively pull and push the ring through the pusher to accelerate and decelerate rolling of the ring over the surface.

17 Claims, 3 Drawing Sheets

GUIDED ROLLING CIRCLE GAME

BACKGROUND OF THE INVENTION

1. Field of the Invention

This invention relates to an action game for ambulatory children and adults and, more particularly, to a game in which a ring is propelled along a surface as the user thereof either walks or runs.

2. Background Art

Many decades ago, a game was devised utilizing a ring which a user continuously rolled as he/she walked or ran. The object of the game was to keep the ring rolling along a desired course and often to see how rapid a rate the ring could be kept moving at.

The game included an elongate pusher to be held by the user. The pusher had an elongate rod with a proximal end to be grasped by the hand of the user to conveniently hold the pusher in an elevated position. A contact bar was provided at the distal end of the rod and extended at a right angle to the length thereof so as to define a T-shaped configuration. The contact bar defined a surface to be directly engaged with the peripheral surface of the ring.

To start the game, the user would set the ring on the ground and place it in motion. The user would then hold the pusher and place the contact bar thereon directly against the rolling ring and effect propulsion thereof.

The game was devised for several reasons. First, it served as a diversion to those taking an otherwise monotonous walk. It afforded a challenge to the user who might try to achieve personal goals or compete with others. It further provided an inducement for individuals who wanted to realize the benefits of walking or running. It also served the function of providing pure entertainment.

The inventor herein believes that the above game lost popularity for several reasons. First of all, the ring was normally made from a lightweight material having a circular cross section, similar to the shape of a conventional hula hoop. As the ring rolled, it tended to twist and skid uncontrollably in that there was no significant traction surface thereon.

Another problem with the above game was that it was difficult to maintain control of the ring, particularly on inclined surfaces and irregular terrain. The user was required to place a relatively small and flat contact bar surface against the curved peripheral surface of the ring as the ring moved oft times at fairly rapid speeds. This not only caused frustration on the part of the user but introduced the element of danger. The user would have to focus his/her attention on propelling the ring and in so doing could have their attention diverted sufficiently that the user could unknowingly walk dangerously into a street or surrounding objects or could trip on an uneven terrain. This problem was aggravated by the poor traction that the ring had on virtually all types of surfaces.

As a result, this game became impractical and is particularly so in today's environment where there is such a tremendous focus on safety in games, particularly children games.

SUMMARY OF THE INVENTION

According to the invention, a game is provided having a ring with a peripheral outer surface to be engaged with and rolled over a subjacent surface supporting the ring and a pusher for propelling the ring by rolling thereof. The pusher is a rod having a proximal end and a distal end with the proximal end being configured to be grasped by a user. The distal end of the rod cooperates with the ring in such a manner that the user can selectively pull and push the ring through the pusher to selectively accelerate and decelerate rolling of the ring over the surface.

With the inventive structure, the user can realize all the benefits of the aforementioned prior art rolling ring game without fear of uncontrolled separation of the ring and pusher.

In one form, there is a hook at the distal end of the rod to surround at least a portion of the ring. Preferably, the hook extends through at least 180° around the ring.

This arrangement affords the user a substantial amount of lateral control of the ring as well as the ability to push and pull thereon.

In one form, the hook defines a curved seat for the ring, with the ring and pusher in operative relationship, and an entryway into the curved seat. A closure can be provided to releasably block the entryway to prevent separation of the ring and pusher from their operative relationship with the closure in a closed state.

Accordingly, the closure can be constructed so that the ring and pusher are inseparable with the closure in its closed state. This allows the user to focus fully on other than maintaining the pusher and ring in their operative relationship.

The closure can take a variety of different forms. In one form, a latch element is mounted to the hook for movement relative thereto between open and closed states. The latch element can be pivoted relative to the hook and in one form is biased normally to one of the open and closed states and, more desirably, to the closed state.

To facilitate storage, a separate structure can be provided on the pusher to releasably hold the ring. This facilitates compact storage of the ring and pusher.

To accommodate users of different height and to select a desired push angle, the pusher rod can be constructed so that its length is variable. Various mechanisms are known in the art to vary the length of a rod. With the rod made straight, telescoping engagement can be made between separate rod parts which can be selectively locked relative to each other to fix the overall effective length of the rod.

Although a separate grip element is not required at the proximal end of the rod, in one form, a grip element is provided both for comfort and to improve the user's control of the pusher. The grip element has a first portion to be gripped by the thumb and index finger of a user and a rear portion. The rear portion of the grip element is larger than the front portion of the grip element to prevent a user's hand from sliding off of the grip element as the pusher is pulled by a user.

To prevent slipping of the ring on a support surface, one or more traction ribs can be provided thereon to extend radially outwardly from the peripheral outer surface of the ring. In a more preferred form, axially spaced traction ribs are provided on the peripheral outer surface of the ring. The ribs may be made from a material that is different than the material making up the peripheral outer surface of the ring and more preferably from a material having a higher coefficient of friction.

In another form of the invention, a game is provided having a ring and pusher with there being a hook at the distal end of the pusher defining a receptacle for the ring and allowing the ring to be rolled by the pusher with the ring in the hook receptacle.

DETAILED DESCRIPTION OF THE DRAWINGS

Figures 1, 6:
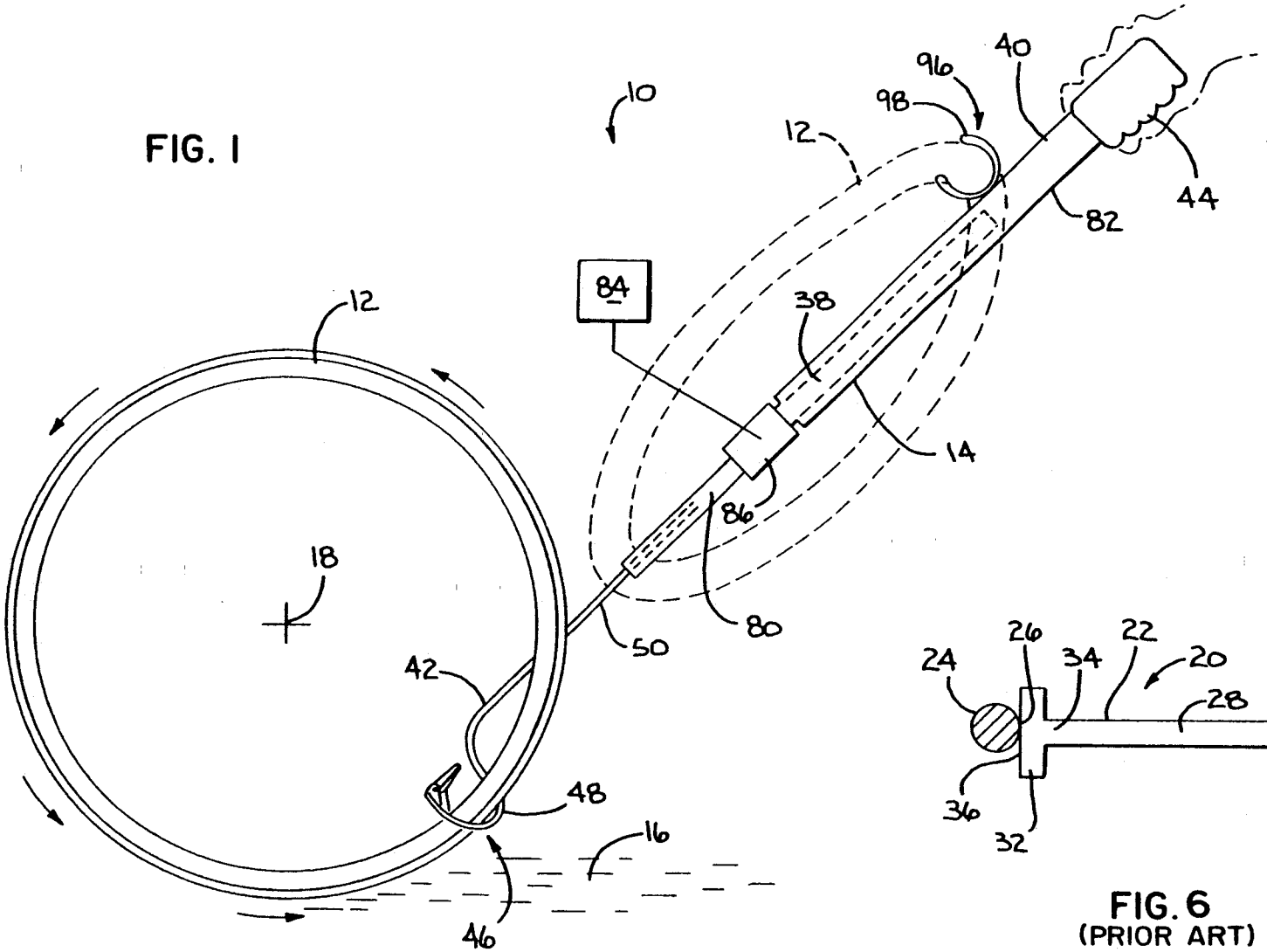
FIG. 6 (PRIOR ART)
FIG. 1 is a perspective view of a game, according to the present invention, including a ring and pusher operatively engaged with the pusher and being controlled by a user rolling the ring.
FIG. 6 is a schematic representation of a prior art game having a cooperating pusher and ring.

A game, according to the present invention is shown at 10 in FIG. 1 and includes an annular, substantially circular ring 12 and a pusher 14. The object of the game is to place the ring 12 on a support surface 16 and, through the pusher 14, roll the ring 12 against the support surface of 16 about its axis 18. It should be understood that "ring", as used herein is intended to generally cover different types of circular elements, capable of being rolled along a support surface therefor. Before getting into the details of the inventive game 10, a prior art game 20, shown in FIG. 6, will be described.

The prior art game 20 consists of a pusher 22 for a ring 24. The ring 24 is circular with a circular cross section. The ring 24 has a peripheral outer surface 26 to be rolled against a subjacent support surface.

To propel the ring 24, the user presses against the peripheral outer ring surface 26 with the pusher 22. The pusher 22 has an elongate shaft 28 with a proximal end 30 that can be grasped by the hand of a user to hold the pusher 22 in an elevated state. A pusher bar 32 is connected to the distal end 34 of the shaft 28 to be substantially at right angles to the length thereof. The pusher bar 32 has a flat leading surface 36 to directly engage the peripheral outer surface of the ring 24.

Because the axial contact area between the peripheral outer surface 26 of the ring 24 and the subjacent support surface is minimal, the ring 24 has a tendency to slip on and wobble relative to the support surface. Thus it becomes a relatively difficult exercise for the user to propel the ring 24, catch up with the propelled ring, and re-engage the surface 36 in a manner that permits the pusher 22 to be thrust forwardly to again impart a propulsion force.

Another problem is that the user may easily lose control of the ring 24, particularly on inclined surfaces. If the ring 24 is propelled down an incline, the user may find it difficult or impossible to keep up with the ring 24. These problems are solved, and other advantages are afforded, by the present invention.

More particularly, the pusher 14 is in the form of an elongate rod 38 having a proximal end 40 and a distal end 42. An optional grip element 44 surrounds the proximal rod end 40 and may be cushioned and contoured to allow the user to positively grasp and manipulate the rod 38.

Figure 4:
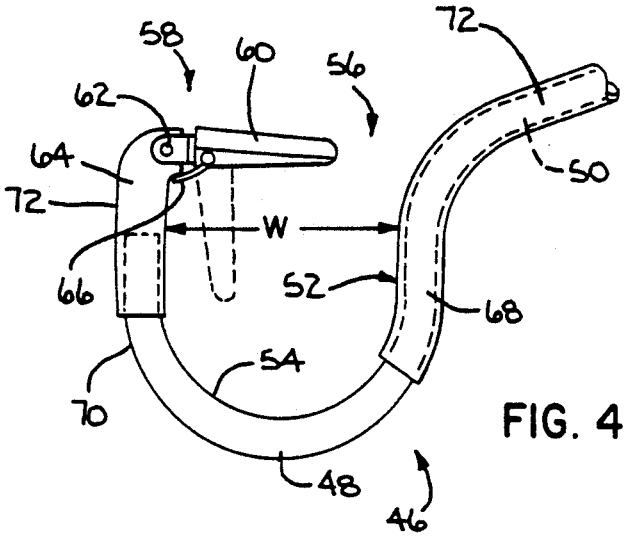
FIG. 4 is an enlarged end view of a hook on the pusher that engages the ring in use.

At the distal end 42 of the rod 38, means are provided at 46 to cooperate with the ring 12 to allow a user to controllably pull and push the ring 12 to selectively accelerate and decelerate rolling of the ring 12 over the subjacent surface 16. The means 46 includes a hook 48 integrally bent from a rod part 50. The details of the means 46 are shown clearly in FIGS. 1 and 4.

The hook 48 is bent through at least 180° and defines a receptacle 52 for the ring bounded by a curved surface/seat 54. The hook 48 has an entryway 56 which allows the ring 12 to be directed therethrough and into operative relationship within the receptacle 52.

To releasably maintain the ring 12 within the receptacle 52 and the ring 12 and pusher 14 in operative relationship, a closure means is provided at 58. The closure means 58 includes a latch element 60 that is mounted by a pin 62 for pivoting movement relative to a free end 64 of the hook 48 between an open position, shown in phantom lines in FIG. 4, and a closed position, shown in solid lines in FIGS. 1 and 4. A coil spring 66 normally biases the latch element 60 into the closed position therefor.

The plane of the hook 48 is substantially at right angles to the length of the rod 38 so that with the ring 12 in operative relationship with the pusher 14, the rod is situated slightly axially to the side of the ring 12, shown in FIG. 1.

To assemble the ring 12 and pusher 14, the ring 12 is pressed against the latch element 60 to cam the latch element 60 to the open state therefor. Once the ring 12 fully seats in the receptacle 52, the latch element 60 springs back to its closed state to thereby captively maintain the ring within the receptacle 52. The ring 12 is loosely received within the receptacle 52 so that the ring 12 and hook 48 do not bind appreciably in use.

As the user situates the pusher 14 as in FIG. 1 and presses forwardly thereon to propel the ring 12, the forward force on the ring 12 is imparted principally by the surface 54. The ring 12 is confined in a lateral direction by the spaced legs 68, 70 of the hook 48 and is confined in a fore and oft directions by the latch element 60 and surface 54.

In one form, the rod part 50 is made from formed metal. A hard rubber coating 72 can be provided strategically on that portion of the rod part 50 that will be contacted by the ring 12 in use. The rubber is chosen to have a low coefficient of friction so that the ring 12 rolls without interference thereagainst.

In one exemplary construction, the spacing between the legs 68, 70 of the hook 48 is chosen so that the entryway has an approximate width (W) of 1¼". This hook size is chosen to accommodate a ring 12 having a cross-sectional diameter (D) of approximately 1 inch. The ring 12 is preferably made from plastic, hollow tubing having a 1/16 inch wall thickness.

Figure 2:
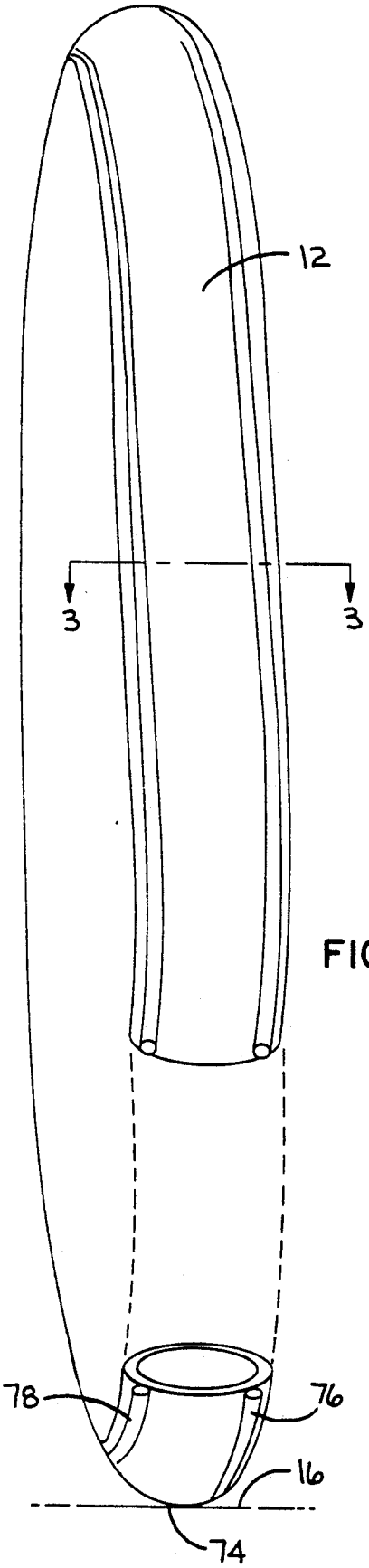
FIG. 2 is a fragmentary perspective view of the ring.
Figure 3:
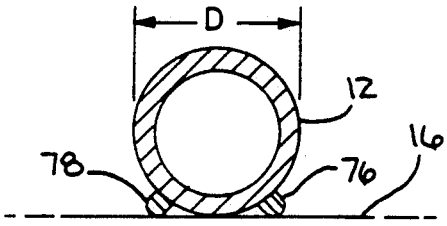
FIG. 3 is a cross sectional view of the ring taken along line 3—3 of FIG. 2.

As seen in FIG. 2, the peripheral outer surface 74 of the ring 12 contacts the subjacent surface 16 over a very narrow axial width. Since the plastic, which preferably makes up the ring 12, has a low coefficient of friction, there is a tendency of the ring 12 to slip relative to the surface 16. To avoid this problem, traction ribs 76, 78 can be provided around the circumference of the ring 12. The ribs 76, 78 extend partially around, and more preferably continuously around the circumference of the ring 12. As seen in FIG. 3, the ribs 76, 78 stabilize the ring 12 and afford a three point contact between the ring 12 and support surface 16. In one form, the ribs 76, 78 are made from a rubber material or another material having a higher coefficient of friction than the material making up the ring 12.

Another aspect of the invention is the provision of structure to allow the effective length of the pusher 14 to be selectively varied. As shown in FIG. 1, the pusher 14 is defined by three telescopingly engaged parts. The rod part 50 fits within a first sleeve 80, which in turn is received within a second sleeve 82. The rod part 50 and sleeves 80, 82 can be telescoped, one within the other, to select a desired length defined cooperatively by those elements. A locking means shown schematically at 84, is used to fix the relative positions of at least the sleeves 80, 82 and potentially the rod part 50. Suitable locking means 84 are known to those skilled in the art. A preferred form employs camming elements on the cooperating parts 50, 82, 84 which are controlled by twisting movement of a collar 86. By gripping the element 44 in one hand and rotating the collar 86 in one direction, the rod part 50 and sleeves 80, 82 can be released from each other. Rotation of the collar 86 oppositely to the one direction effects locking of the rod part 50 and sleeves 80, 82 in a desired relationship.

The adjusting capability for the rod 38 makes it universal in nature, for children as well as taller adults. The overall length of the pusher is preferably on the order of three to four feet to be used with a ring 12 having a diameter of approximately 3½ feet. With the adjusting capability incorporated, the pusher 14 can be shortened and lengthened by as much as two feet.

Figure 5:
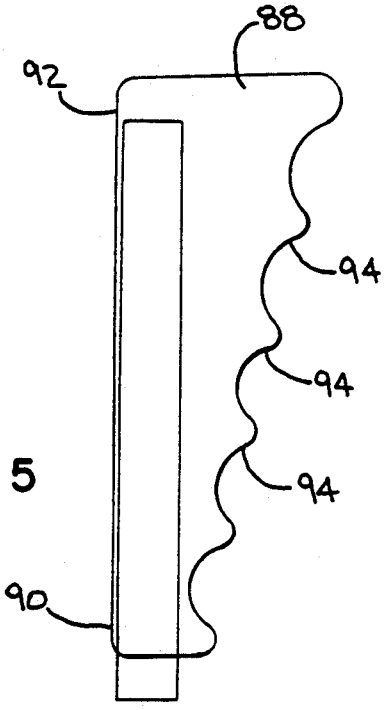
FIG. 5 is a side elevation view of a grip element that can be provided on the pusher to facilitate manipulation thereof.
Figure 7:
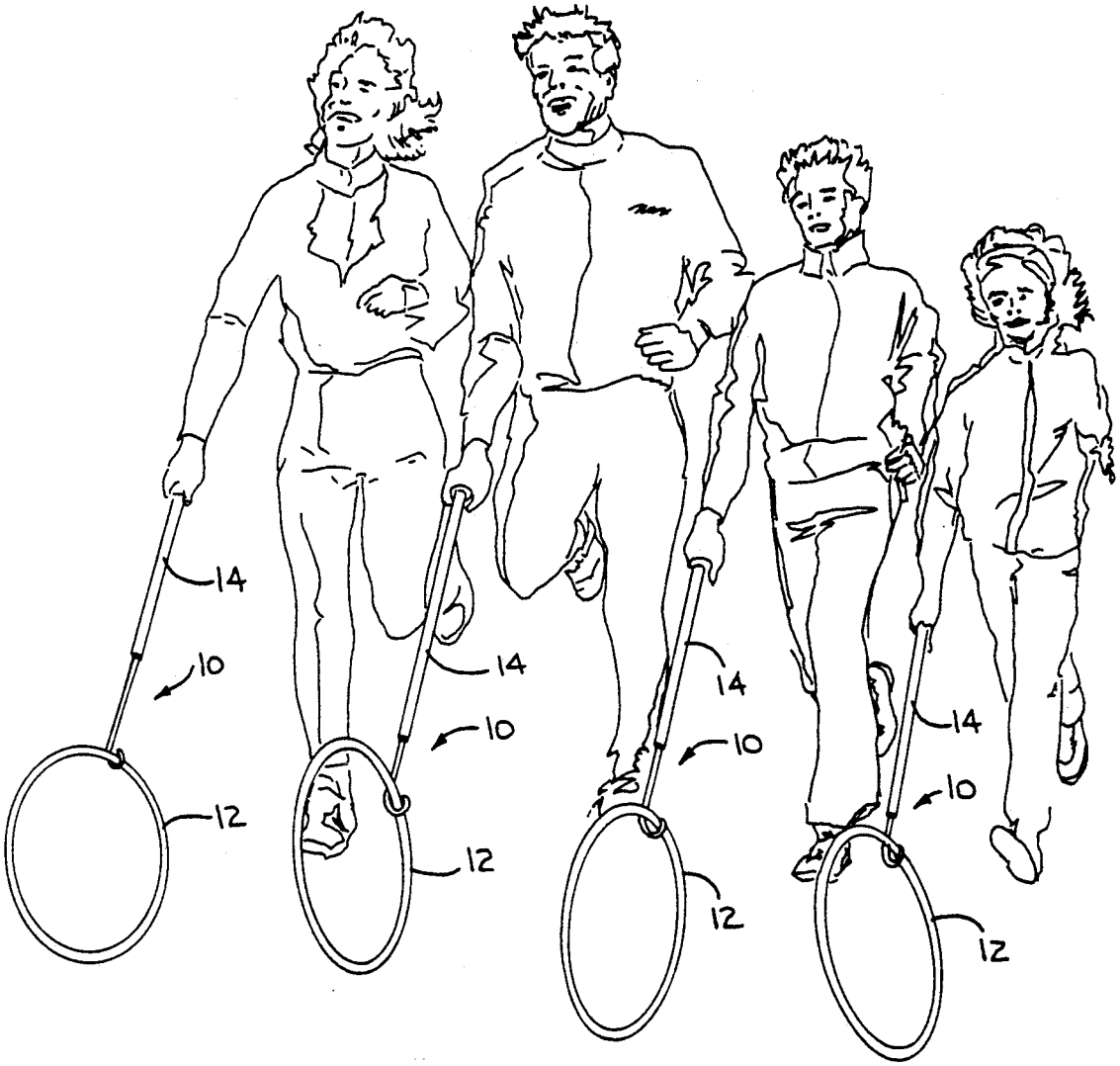
FIG. 7 is a perspective view showing a plurality of users operating the inventive game.

Another aspect of the invention is the provision of a grip element 88, shown in FIG. 5, that facilitates pushing and pulling of the ring 12 through the pusher 14. The grip element 88 has a front portion 90 and a rear portion 92. The front portion 90 is designed to be engaged between the thumb and index finger of the user. The rear portion 92 accommodates the hand in the vicinity of the little finger. By tapering the grip element 88 so that the rear portion 92 is larger than the front portion 90, the user's hand is not prone to sliding off. Finger-receiving undercuts 94 are also provided in the grip element 88 to both add to the comfort and allow a more positive grip to be effected.

A further aspect of the invention is the provision of a means at 96 on the pusher 14 to hold the ring 12 in the storage position, as shown in FIG. 1. The means 96 is, in one form, a resilient C-clip 98 which snaps around to frictionally engage the ring 12. With the ring 12 in a storage position in FIG. 1, the ring 12 and pusher 14 have a combined compact configuration, which facilitates storage and transportation thereof.

The foregoing disclosure of specific embodiments is intended to be illustrative of the broad concepts comprehended by the invention.

I claim:

1. A rolling ring game comprising:

a ring having a peripheral outer surface to be engaged with and rolled over a subjacent surface supporting the ring; and a pusher for propelling the ring by rolling thereof, said pusher comprising a rod having a proximal end and a distal end, there being means on the proximal end to be gripped by a user, there being means cooperating between the ring and distal end of the rod for allowing a user to selectively pull and push the ring through the pusher to accelerate and decelerate rolling thereof over a subjacent surface, wherein the cooperating means includes a hook that surrounds at least a portion of the ring and the hook defines a curved seat for the ring and an entry way into the curved seat, said cooperating means further including a closure means for releasably blocking the entryway to prevent separation of the ring and pusher from their operative relationship with the closure means in a closed state.

2. The rolling ring game of claim 1 wherein the pusher hook extends through at least 180° around the ring.

3. The rolling ring game of claim 1 wherein the closure means comprises a latch element and there are means for mounting the latch element to the hook for movement relative thereto between an open state wherein the ring can be directed into and out of the entryway and a closed state.

4. The rolling ring game of claim 3 wherein the means for mounting the latch element mounts the latch element for pivoting movement relative to the hook.

5. The rolling ring game of claim 3 wherein there are means cooperating between the hook and latch element for normally biasing the latch element to one of its open and closed states.

6. The rolling ring game of claim 1 wherein there are means cooperating between the ring and pusher for holding the ring in a storage position on the pusher, said pusher and ring being in a different relative position in the storage position than in their operative relationship.

7. The rolling ring game of claim 1 wherein the pusher rod has a length and there are means for selectively varying the length of the pusher rod.

8. The rolling ring game of claim 1 where the means to be gripped at the proximal end of the pusher comprises a grip element with a front portion to be gripped by the thumb and index finger of a user and a rear portion, said rear portion of the grip element being larger than the front part of the grip element to prevent a user's hand from sliding off of the grip element as the pusher is pulled by a user.

9. The rolling ring game of claim 1 wherein the ring has an axis and there is a traction rib extending radially outwardly from the peripheral outer surface of the ring to avoid slipping of the peripheral outer surface of the ring on a subjacent surface.

10. The rolling ring game of claim 9 wherein the peripheral outer surface of the ring and the traction rib are made from different materials.

11. The rolling ring game of claim 10 wherein the material making up the traction rib has a higher coefficient of friction than the material making up the peripheral outer surface of the ring.

12. A rolling ring game comprising:

a ring having a peripheral outer surface to be engaged with and rolled over a subjacent surface supporting the ring; and a pusher for propelling the ring by rolling thereof, said pusher comprising a rod having a proximal end and a distal end;

there being means on the proximal end to be gripped by a user, there being means cooperating between the ring and distal end of the rod for allowing a user to selectively pull and push the ring through the pusher to accelerate and decelerate rolling thereof over a subjacent surface wherein the ring has an axis and there being axially spaced first and second traction ribs on the peripheral outer surface of the ring extending radially outwardly from the peripheral outer surface of the ring to avoid slipping of the peripheral outer surface of the ring on a subjacent surface.

13. The rolling ring to claim 12 wherein the first and second traction ribs extend continuously around the peripheral outer surface of the ring.

14. A game comprising:

a ring having a peripheral outer surface to be engaged with and rolled over a subjacent surface supporting the ring; and a pusher for propelling the ring by rolling thereof, said pusher comprising a rod having a proximal and distal end, there being means on the proximal end to be gripped by a user, there being a hook at the distal end of the pusher defining a receptacle for the ring and allowing the ring to be rolled by the pusher with the ring in the hook receptacle.

wherein the hook defines a curved seat for the ring with the ring and pusher in operative relationship and an entryway into the curved seat, said hook further including a closure means for releasably blocking the entryway to prevent separation of the ring and pusher from their operative relationship with the closure means in a closed state.

15. The rolling ring game of claim 14 wherein the closure means comprises a latch element and there are means for mounting the latch element to the hook for movement relative thereto between an open state wherein the ring an be directed into and out of the entryway and a closed state.

16. The rolling ring game of claim 15 wherein the means for mounting the latch element mounts the latch element for pivoting movement relative to the hook.

17. The rolling ring game of claim 15 wherein there are means cooperating between the hook and latch element for normally biasing the latch element to one of its open and closed states.

* * * * *